US010703981B2

(12) United States Patent
Urynowicz et al.

(10) Patent No.: US 10,703,981 B2
(45) Date of Patent: Jul. 7, 2020

(54) ENZYMATIC DEPOLYMERIZATION AND SOLUBILIZATION OF CHEMICALLY PRETREATED COAL AND COAL-DERIVED CONSTITUENTS

(71) Applicant: University of Wyoming, Laramie, WY (US)

(72) Inventors: Michael A. Urynowicz, Fort Collins, CO (US); Zaixing Huang, Laramie, WY (US)

(73) Assignee: University of Wyoming, Laramie, WY (US)

( * ) Notice: Subject to any disclaimer, the term of this patent is extended or adjusted under 35 U.S.C. 154(b) by 188 days.

(21) Appl. No.: 13/901,470

(22) Filed: May 23, 2013

(65) Prior Publication Data

US 2014/0346090 A1 Nov. 27, 2014

Related U.S. Application Data

(60) Provisional application No. 61/650,576, filed on May 23, 2012.

(51) Int. Cl.
*C10G 1/00* (2006.01)

(52) U.S. Cl.
CPC ..... *C10G 1/002* (2013.01); *C10G 1/00* (2013.01)

(58) Field of Classification Search
CPC ..... C10G 1/00; C10G 1/002; C10G 17/00; C10G 17/02; C10G 27/04; C10G 27/12
See application file for complete search history.

(56) References Cited

U.S. PATENT DOCUMENTS 4,759,772 A * 7/1988 Rogers ..... C10L 9/10 44/501
4,882,274 A * 11/1989 Pyne et al. ..... 435/71.1
(Continued)

OTHER PUBLICATIONS

Vares, et al., Lignin Peroxidases, Manganese Peroxidases, and Other Ligninolytic Enzymes Produced by Phlebia radiata during Solid-State Fermentation of Wheat Straw, 1995, Applied and Environmental Microbiology, vol. 61, No. 10, pp. 3515-3520.*
(Continued)

*Primary Examiner* — Derek N Mueller
(74) *Attorney, Agent, or Firm* — Samuel M. Freund; Cochran Freund & Young LLC

(57) ABSTRACT

Use of chemical pretreatment agents on the subsequent enzymatic conversion of coal is described. As an example, fungal manganese peroxidase (MnP) produced by the agaric white-rot fungus *Bjerkandera adusta*, where the enzyme MnP has little effect on the untreated coal controls, was investigated. The nature of pretreatment agents and their applied concentrations were found to have significant impact on subsequent enzymatic conversion of coal. Four agents were investigated: $HNO_3$, catalyzed $H_2O_2$, $KMnO_4$, and NaOH. Hydrogen peroxide was found to generate the greatest quantity of total organic carbon from the coal samples employed. Combined chemical and enzymatic treatment of coal is appropriate for enhanced depolymerisation of coal and coal-derived constituents and results in chemically heterogeneous and complex liquefaction products like humic and fulvic acids, which will have important ramifications in the generation of liquid and gaseous fuels from coals as nonpetroleum-derived fuel alternatives.

8 Claims, 5 Drawing Sheets

(56) References Cited

U.S. PATENT DOCUMENTS

| | | | |
|---|---|---|---|
| 4,960,699 | A | 10/1990 | Wood et al. |
| 7,556,094 | B1 | 7/2009 | Urynowicz et al. |
| 2009/0123979 | A1 | 5/2009 | Xu |
| 2010/0159509 | A1 | 6/2010 | Xu et al. |

OTHER PUBLICATIONS

Roling, W.F.M., Hydrocarbon-Degradation by Acidophilic Microorganisms, 2010, Handbook of Hydrocarbon and Lipid Microbiology, Springer-Verlag Berlin Heidelberg, pp. 1924-1929.*

Schons, et al. Immobilization of Paecilomyces variotii tannase and properties of the immobilized enzyme, 2011, Journal of Microencapsulation, vol. 28, issue 3, pp. 211-219.*

Forsey, S.P., In Situ Chemical Oxidation of Creosote/Coal Tar Residuals: Experimental and Numerical Investigation, 2004, University of Waterloo, pp. 65-104.*

Wondrack, et al., Depolymerization by Lignin Peroxidase, Applied Chemistry and Biotechnology, 1989, vol. 20/21, pp. 765-779.*

International Search Report, International Searching Authority, dated Nov. 12, 2013, pp. 1-17.

Au Patent Examination Report No. 1, Uk application no. 2013266199, dated Jan. 22, 2016, 3 total pp.

* cited by examiner

ENZYMATIC DEPOLYMERIZATION AND SOLUBILIZATION OF CHEMICALLY PRETREATED COAL AND COAL-DERIVED CONSTITUENTS

CROSS-REFERENCE TO RELATED APPLICATIONS

The present application claims the benefit of U.S. Provisional Patent Application No. 61/650,576 for "Depolymerization And Solubilization Of Chemically Pretreated Coal By Manganese Peroxidase From *Bjerkandera Adusta*," by Michael A. Urynowicz et al., which was filed on 23 May 2012, the entire contents of which is hereby specifically incorporated by reference herein for all that it discloses and teaches.

STATEMENT REGARDING FEDERAL RIGHTS

This invention was made with government support under Contract No. RPSEA 07122-14 awarded by the Research Partnership to Secure Energy for America to The Regents of The University of Wyoming. The government has certain rights in the invention.

FIELD OF THE INVENTION

Embodiments of the present invention relate generally to the enzymatic depolymerization and solubilization of highly complex structural biopolymers found in coal and, more particularly, to the use of chemical pretreatment agents followed by subsequent enzymatic conversion to significantly improve the depolymerization and solubilization of highly complex structural biopolymers found in coal.

BACKGROUND OF THE INVENTION

Coal can be described as a coal complex polymer or macromolecule consisting of a condensed aromatic carbon-atom lattice surrounded by a typical "fringe" formed by functional side groups. It can also be described as a heterogeneous mixture composed of a macromolecular network with varying degrees of cross-linking. Coal consists of modified lignin, as well as cellulose and melanoidin-type materials which are considered to be the "backbone" of the macromolecular network. Cross-linkage is generally dominated by alkyl and aryl ether groups, especially in low-rank coal, with oxygen functional groups, while the degree of aromaticity tends to increase with coal rank. Because of its complexity and heterogeneity, it is very difficult to depolymerize and solubilize coal without subjecting it to extreme physical (temperature, pressure, etc.) and/or chemical (pH, redox potential, solvation energy, etc.) conditions.

Manganese peroxidase (MnP, Enzyme Commission Number (EC) 1.11.1.7) is one of the most common and efficient extracellular lignin-modifying heme-peroxidases secreted by "classic" white-rot fungi (See, e.g., Hofrichter, M., 2002, Enzyme and Microbial Technology 30, 454-466; Martinez, 2002, Enzyme and Microbial Technology 30, 425-444; Hatakka, A. et al., 2003. Manganese peroxidase and its role in the degradation of wood lignin. In Mansfield SD, Saddler JN (eds) Applications of Enzymes to Lignocellulosics, ACS Symposium Series 855. American Chemical Society, Washington D.C., Chapter 14, 230-243; and Hatakka A. et al., 2010. Fungal biodegradation of lignocelluloses. In: Hofrichter M. (ed.) The Mycota, X, Industrial applications, 2nd Ed. Springer, Berlin Heidelberg N.Y.). The enzyme has been shown to efficiently oxidize a number of recalcitrant polymers (e.g., polycyclic aromatic hydrocarbons, organohalogens, nitroaromatic compounds, and natural substances like lignins, milled wood and humic substances) derived from low rank coal or low-rank coal and other persistent aromatics in cell-free reaction systems (in vitro) (See, e.g., Hofrichter et al., 1996, Appl. Microbiol. Biotechnol. 46, 220-225; Hofrichter et al., 1997 a. Appl. Microbiol. Biotechnol. 47, 419-424, and Hofrichter, 1997 b. Appl. Microbiol. Biotechnol. 47, 566-571; Ziegenhagen et al., 1998, J. Basic Microbiol. 38, 289-299; Hofrichter et al., 1998, Appl. Microbiol. Biotechnol. 49, 584-588; Hofrichter et al., 1999, Appl. Microbiol. and Biotech. 52, 78-84; Hakala et al., 2006, Appl Microbiol. Biotechnol. 73, 839-849; and Hofrichter et al., 2010, Appl. Micribiol. Biotechnol. 87, 871-897.). The fungus, *Paecilomyces variotii* is known to produce a variety of enzymes including tannase.

Manganese peroxidase belongs to the class II peroxidase group of the plant peroxidase superfamily that is characterized by a protoporphyrin IX (heme) as a prosthetic group in the active center (Welinder, 1992, Current Opinion in Structural Biology 2, 388-393; Poulos et al., 1978, J. Biol. Chem. 253, 3730-3735; Piontek et al., 1993, FEBS Letters 315, 119-124; and Hofrichter et al., 2010, supra.). The catalytic cycle of the enzyme behaves like other well-known heme peroxidases such as lignin peroxidases (LiP, EC 1.11.1.14) and the peroxidase of Coprinopsis cinerea (CiP, EC 1.11.1.7), except that MnP uses $Mn^{2+}$ ions as the preferred electron donor. The catalytic cycle is activated by $H_2O_2$. The native MnP is oxidized to intermediate forms which then oxidize $Mn^{2+}$ to $Mn^{3+}$ and return it to its native form. Manganese(III) is highly reactive and both chelated and stabilized by organic acids such as oxalate or malonate (See, e.g., Wariishi et al., 1992, J. Biol. Chem. 267, 23688-23695; and Hofrichter et al., 2001, Appl. and Environ. Microbiol. 67, 4588-4593). Chelated $Mn^{3+}$ ions act as strong, diffusible redox mediators that are able to attack organic bonds in large biopolymers non-specifically.

SUMMARY OF THE INVENTION

Embodiments of the present invention overcome the disadvantages and limitations of prior art by providing a method for improving the enzymatic depolymerization and solubilization of highly complex structural biopolymers found in coal.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the method for depolymerizing and solubilizing coal and coal-derived constituents, hereof, includes: treating the coal with an aqueous solution including at least one oxidizing agent, forming thereby treated coal and coal-derived constituents; and exposing the treated coal and coal-derived constituents to an aqueous solution including at least one enzyme effective for reacting with coal and coal-derived constituents.

In another aspect of the present invention, in accordance with its objects and purposes, the method for depolymerizing and solubilizing coal and coal-derived constituents, hereof, includes: treating the coal with an aqueous solution including at least one acid, forming thereby coal and coal-derived constituents; and exposing the treated coal and coal-derived constituents to an aqueous solution including at least one enzyme effective for reacting with coal and coal-derived constituents.

In yet another aspect of the present invention, in accordance with its objects and purposes, the method for depolymerizing and solubilizing coal and coal-derived constituents, hereof includes: treating the coal with an aqueous solution including at least one base, forming thereby treated coal and coal-derived constituents; and exposing the treated coal and coal-derived constituents to an aqueous solution including at least one enzyme effective for reacting with coal and coal-derived constituents.

Benefits and advantages of the present invention include, but are not limited to, providing a method for improving enzymatic depolymerization and solubilization of highly complex structural biopolymers found in coal.

BRIEF DESCRIPTION OF THE DRAWINGS

The accompanying drawings, which are incorporated in and form a part of the specification, illustrate two embodiments of the present invention and, together with the description, serve to explain the principles of the invention.

FIGS. 3A-3D are graphs of the HPSEC elution profiles of water-soluble aromatic fragments released from coal (PRB) after combined chemical and enzymatic (1 U $ml^{-1}$ MnP) treatment at ambient temperature, wherein FIG. 3A represents $HNO_3$+MnP; FIG. 3B represents $H_2O_2$+MnP; FIG. 3C represents $KMnO_4$+MnP; and FIG. 3D represents NaOH+MnP, where the dotted lines represent the enzymatic controls without any chemical pretreatment; the dashed lines represents low chemical concentrations; the thin lines represent medium chemical concentrations; and the thick lines represent high chemical concentrations, and where the data points represent the means of three replicates with standard deviation values of <5%.

DETAILED DESCRIPTION

Figure 1:
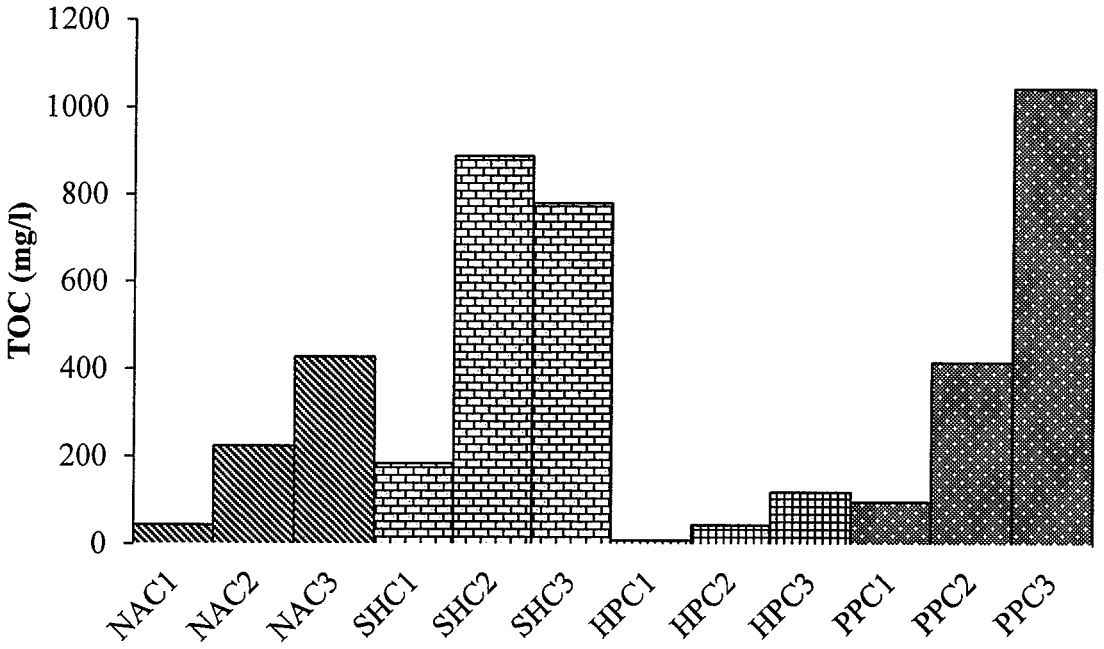
FIG. 1 is a graph of the total organic carbon (TOC) from chemical pretreatments after 24 hours for sodium hydroxide (SH), nitric acid (NA), hydrogen peroxide (catalyzed) (HP), potassium permanganate (PP); low concentration (C1) medium concentration (C2) and high concentration (C3), where the data points represent the means of three replicates.

Briefly, embodiments of the present invention include the use of chemical pretreatment agents for the subsequent enzymatic conversion of coal and coal derived constituents, the enzymes by themselves having little effect on the untreated coal controls. The nature of pretreatment agents and their applied concentrations were found to have significant impact on subsequent enzymatic conversion of coal. Four agents were investigated: $HNO_3$, catalyzed $H_2O_2$, $KMnO_4$, and NaOH. As will be described hereinbelow, hydrogen peroxide generated the greatest quantity of total organic carbon from the coal samples employed. Chemical pretreatment in accordance with embodiments of the present invention creates two fractions: treated coal and coal derived constituents. The coal is the solid fraction and the coal-derived constituents are the aqueous fraction (the coal that has been solubilized). The enzymatic treatments are shown to enhance the solubilization of the solid fraction (the chemical treated coal) and alter the coal-derived constituents (the coal that was solubilized from the chemical treatment). The coal-derived constituents are transformed from higher molecular weight compounds that aren't readily biodegradable to lower molecular weight compounds that tend to be more readily biodegradable.

A. Manganese Peroxidase (MnP) from White Rot Fungi:

The catalytic characteristics of MnP, and the relatively mild reaction conditions under which it operates (compared to harsher chemical treatments), have made it a promising treatment agent for the depolymerization of highly complex structural biopolymers like those found in coal. Manganese peroxidases from white rot fungi like *Phlebia radiata, Clitocybula dusenii* and *Bjerkandera adusta* may be produced on a large scales (e.g., total volumes of 300 L with maximum activities of ~2000 U $L^{-1}$). In addition, the enzymes are stable and able to effectively depolymerize and solubilize humic acids derived from low-rank coals (See, e.g., Hofrichter et al., 1997, supra; and Nueske, J. et al., 2002, Enzyme and Microbial Technol. 30, 556-561.). Other fungi, including *Paecilomyces variotii*, discussed hereinbelow, generate a wide variety of enzymes effective for acting on coal and coal-derived constituents.

The effects of the combined chemical and enzymatic treatments were analyzed by high performance size exclusion chromatography (HPSEC) and 3-dimensional excitation emission matrix fluorescence spectroscopy (3D-EEM). The 3D-EEM spectroscopic analysis provided insight into the nature of the depolymerized and released coal constituents. Using the fluorescence spectra, it was possible to distinguish among humic-like, fulvic acid-like, protein-like, and aromatic/polycyclic aromatic hydrocarbon (PAH)-like substances. Low molecular-weight aromatic fragments having sizes ranging from about 1.2 to about 5.3 kDa were released by all of the pretreatment agents used in combination with MnP. For $KMnO_4$ and $HNO_3$ pretreated coal, the EEM regions 307.5/422 nm and 232.5/426 nm, and 340/448 nm and 242.5/484 nm for humic and fulvic acid-like fragments, respectively, were found to increase after MnP treatment.

Powder River Basin (PRB) coal pretreated by various chemical agents, including two oxidants (catalyzed and uncatalyzed hydrogen peroxide and permanganate), one acid (nitric acid) and one base (sodium hydroxide), was followed by treatment using cell-free enzymatic reaction systems (in vitro) for depolymerization, for example MnP. Following solubilization and depolymerization of PRB coal, the released fragments were characterized by size exclusion chromatography and fluorescence excitation-emission matrix (EEM) spectroscopy. Total organic carbon (TOC) data of chemical pretreatments was included, but TOC analysis for the subsequent enzymatic treatments was not performed, because the cell-free enzymatic reaction systems were found to contain significant TOC contributed from sources other than the coal itself, for instance, the organic buffer and enzymes.

Fluorescence spectrometry can be used to distinguish humic-like and fulvic acid-like organic matter from protein-like and aromatic/polycyclic aromatic hydrocarbons (PAHs) substances (See, e.g., Tang et al., 2011, Chemosphere 82, 1202-1208; and Jaffrennou et al., 2007, J. Fluorescence 17, 564-572.). Amy et al., 2007, Environmental Monitoring and Assessment 129, 19-26, quantified the fluorescence intensity for protein-like organic matter from wastewater effluent organic matter at an emission wavelength of 330 nm and an excitation wavelength of 270 nm. Humic and fulvic acid-like intensities were quantified at emission wavelengths of 420 and 440 nm and at excitation wavelengths of 330 and 240 nm, respectively. The aromatic compounds with one and two rings are located at emission wavelengths from 300 to 350 nm and at excitation wavelengths from 280 to 330 nm, while PAHs with three to five rings emit between 370 and 480 nm and at excitation wavelengths from 360 to 460 nm (Jaffrennou et al., supra). Chen et al. (2003) divided the matrix into five regions: aromatic protein I, aromatic protein II, fulvic acid-like, soluble microbial by-product-like and humic acid-like regions. The EEM spectroscopy is extensively used to determine protein-like, fulvic acid-like, humic acid-like and aromatic/PAH (1-5 rings) substances (Tang et al., supra; Jaffrennou et al., supra).

1. Organism, Culture Conditions and Enzyme Preparation:

The inoculum for this study was prepared from white-rot fungus *Bjerkandera adusta* on agar plates (basal medium plus 1.5% agar) incubated at 24° C. for 12 days. The basal medium contained 10 g glucose, 2 g $KH_2PO_4$, 0.5 g $MgSO_4.7\ H_2O$, 0.1 g $CaCl_2$, 0.5 g $NH_4$ tartrate, 0.3 g yeast extract, 2 g sodium acetate, 0.015 g $FeSO_4.7\ H_2O$ and 25 mg $MnCl_2$, per liter. Prior to sterilization, the pH was adjusted to 4.5. The fungus was precultured in 500-ml culture flasks containing 200 ml basal medium at 24° C. for 10 to 12 days on a rotary shaker (100 rpm). After suitable levels of biomass growth were attained, the fungal mycelia in the precultures were homogenized and used as inoculum for a 10-liter stirred-tank bioreactor. After growth, sterile samples were taken every second or third day, and the MnP activity as well as the pH of the culture liquid were determined. When maximum MnP activity was reached, the enzyme-containing culture liquid was harvested, separated from the fungal biomass by filtration (filter GF6; Schleicher & Schuell, Dassel, Germany) and concentrated 10-fold at 10° C. in a Pall-Filtron tangential flow system (Dreieich, Germany) using a 10-kDa cutoff filter cassette. The crude enzyme liquid was used in the present conversion studies.

2. Coal:

Coal samples were obtained from the Powder River Basin (PRB) located 31 miles west of the Powder River on the Montana side of the Montana-Wyoming state line. The sample well (SL-5) was located in the Canyon Aquifer at coordinates 45.011890 North and 106.271490 West, lying within the Upper Wyodak Formation. Coal samples were collected on Jun. 10, 2005, from a depth ranging between 408 feet and 431 feet. The coal was dried and ground, and the portion of the coal particles passing through a 60 mesh (0.25 mm) sieve was retained for the chemical enzyme treatment studies.

3. Chemical Pretreatment:

Samples of PRB coal (33 mg) were pretreated with $HNO_3$ (NE), $H_2O_2$(HE), $KMnO_4$ (PE), and NaOH (SE) at low (C1), medium (C2) and high concentrations (C3) for 24 h in 1.5-ml high-performance liquid chromatography (HPLC) vials at ambient temperature in triplicate, and the results are shown in TABLE 1; the catalyst, 0.025 M of Fe (II) was added with the $H_2O_2$. Hydrogen peroxide is decomposed by the soluble Fe (II) or other transition elements to hydroxyl radicals (Fenton reaction) that are strong, nonspecific oxidants capable of reacting with most organic compounds (See, e.g., Watts et al., 1994, J. Hazard. Mat. 39, 33-47).

TABLE 1

| Pretreatment | Concentration (M) | | |
|---|---|---|---|
| Agent | C1 | C2 | C3 |
| $KMnO_4$ | 0.01 | 0.05 | 0.10 |
| $H_2O_2$* | 0.33 | 1.63 | 3.26 |
| $HNO_3$ | 0.33 | 1.67 | 3.33 |
| NaOH | 0.13 | 0.67 | 1.33 |

*Contains 0.025M Fe (II) as catalyst

The final volume of each reaction vial was 1 ml. The vials were centrifuged at 16,000 rpm for 10 min., the supernatant liquid was separated from the coal, and the coal was then resuspended in distilled water and centrifuged at the same speed and duration. This washing process was repeated 10 times to remove any residual chemical agents. The washed coal was then used in enzymatic reactions. The supernatant was filtered through 0.45 μm syringe filters prior to TOC analysis.

Pretreated samples were centrifuged to separate the liquid from the solid, each aliquot of liquid then being filtered through a 0.45 microsyringe filter, and analyzed for Total organic carbon (TOC) with a Shimadzu TOC analyzer (TOC-$V_{CSN}$, Japan).

4. Enzymatic Reactions:

The enzymatic depolymerization of pretreated coal was carried out in the same 1.5-ml HPLC vials at ambient temperature for 24 h. The reaction system was comprised of a sodium malonate buffer (50 mM, pH 4.5), $MnCl_2$ (25 mM), 1 total Unit MnP (1 U $ml^{-1}$), dimethylformamide (0.05%) and $H_2O_2$ (stock solution 150 mM, 2 μl $h^{-1}$). Magnetic stir bars (8×2 mm) were used to mix the solution during the incubation. The $H_2O_2$ was delivered precisely and slowly with an infusion pump (KDS220, KD Scientific, Bath, UK) to prevent enzyme inactivation by heme-bleaching (Hofrichter et al., 2010, supra). After the prescribed incubation time of 24 h, the vials were centrifuged to retain the liquid supernatants, which were filtered through cellulose syringe filters (0.45 μm, Restek, Bellefonte, Pa.) for further analysis. Samples contained water only, dimethylformamide (DMF) without MnP, and MnP without DMF, as well as MnP and DMF without chemical pretreatment agents as controls. DMF was found to support the depolymerization of humic acids (See, e.g., Hofrichter et al., 1997, supra.). The enzymatic control contained MnP, DMF and coal without chemical pretreatment agents.

5. High-Performance Size-Exclusion Chromatography (HPSEC):

A modified high-performance size-exclusion chromatography (HPSEC) method was used to determine the molecular mass distribution of water-soluble aromatics, as described by Hofrichter et al. 1996 and 1997, supra) as well as by Hofrichter et al., 2001, supra. The samples analyzed by an Agilent 1100 series HPLC system equipped with a diode array detector (DAD) and an analytical HPSEC column (Suprema, 10-μm, 300×8 mm diameter, PSS Mainz, Germany). The elution solvent consisted of 80% salt in an aqueous buffer of sodium chloride (3.44 g $l^{-1}$) and dipotassium phosphate (2 g $l^{-1}$), and a 20% organic buffer of acetonitrile. The aqueous buffer was adjusted to pH 10.0.

Polystyrene sulfonate sodium salts (0.891-976 kDa, Polymer Standard Service, Ashton, Md., USA) were used as molecular weight standards. The elution was performed at a flow rate of 1 ml $min^{-1}$ and analyzed at a wavelength of 280 nm, where aromatic substances typically exhibit maximum absorbance. The injection volume was 25 μl for both standards and samples.

6. Three-Dimensional Excitation Emission Matrices Fluorescence Spectrophotometer (3D-EEM):

The 3D-EEM was performed on a Varian Cary Eclipse Fluorescence Spectrophotometer (Agilent, Santa Clara, Calif.). The samples were scanned under emission 3D mode. The scanning emission (Em) spectra from 290 to 590 nm were obtained at 2 nm increments by varying the excitation (Ex) wavelengths from 225 to 450 nm at 2.5 nm increments. The scan rate was 9600 nm $min^{-1}$. Slit bandwidths of 5 nm for both emission and excitation were used at all times.

7. Coal Ultimate Analysis:

All coal analyses were conducted in accordance with ASTM standards D-5142 and D-3176. The element composition of the coal was 74.32% C, 4.16% H, 16.04% 0, 1.41% N and 4.07% S. The heating value was 12603 Btu $lb^{-1}$ on a dry ash free (MAF) basis. TABLE 2 summarizes the ultimate analysis on as received, moisture free and Dry Ash Free (DAF) basis. Oxygen was obtained by calculating the difference. Coal rank was determined using coal properties such as the caloric value, volatile matter and agglomerating character; the coal was classified using the fixed carbon and gross calorific values (ASTM D 388-99, 2005). Higher-rank coals are classified according to fixed carbon on a dry weight basis, while the lower-rank coals are classified according to gross calorific value on a moist, mineral-matter-free basis. The coal was determined to be subbituminous B coal based on its heating value of 9576.3 Btu/lb on a moist, mineral-matter-free basis.

TABLE 2

| | As Received | Moisture Free | DAF Basis |
|---|---|---|---|
| Moisture, wt % | 21.71 | | |
| Hydrogen, wt % | 2.86 | 3.65 | 4.16 |
| Carbon, wt % | 51.05 | 65.20 | 74.32 |
| Nitrogen, wt % | 0.97 | 1.24 | 1.41 |
| Sulfur, wt % | 2.80 | 3.57 | 4.07 |
| Oxygen, wt % | 11.00 | 14.07 | 16.04 |
| Ash, wt % | 9.61 | 12.27 | |
| Heating Value, Btu/lb | 8656 | 11057 | 12603 |

8. Total Organic Carbon (TOC) Analysis:

Reference will now be made in detail to the present embodiments of the invention, examples of which are illustrated in the accompanying drawings. It will be understood that the FIGURES are for the purpose of describing particular embodiments of the invention and are not intended to limit the invention thereto. As illustrated in FIG. 1, TOC analyses indicate that up to 1000 mg/L (PP-C3) of total organic carbon was released by chemical treatment reagents within 24 h. Except for sodium hydroxide, the TOC values are positively correlated to the chemical agent concentrations. It may be observed that potassium permanganate had the highest on a per mol/L increment basis commensurate with TOC, followed by nitric acid and catalyzed hydrogen peroxide. The medium concentration of sodium hydroxide had a higher TOC yield than that of both low- and high-concentrations which is in agreement with previous results of the present inventors (data not shown). Although the catalyzed hydrogen peroxide produced lower TOC values, a mass balance has shown that the treated coal lost more weight than for the other treatments. For example, HP-C3 lost 13.1% of its original weight, while NA-C3 lost only 4.3%; however, the TOC contained in the liquid sample from HP-C3 accounts for only about 0.5% of the coal weight lost. This suggests that some of the products in the catalyzed hydrogen peroxide pretreatment may have been lost by over-oxidation because of the high redox potential (See, e.g., Davidson et al., 1966, Proc. Div. Refin. API 46, 299-302; and Barbeni et al., 1987, Chemosphere 16, 2225-2237.). Additionally, a precipitate containing the Fe(II) catalyst may have removed additional products.

Figure 2:
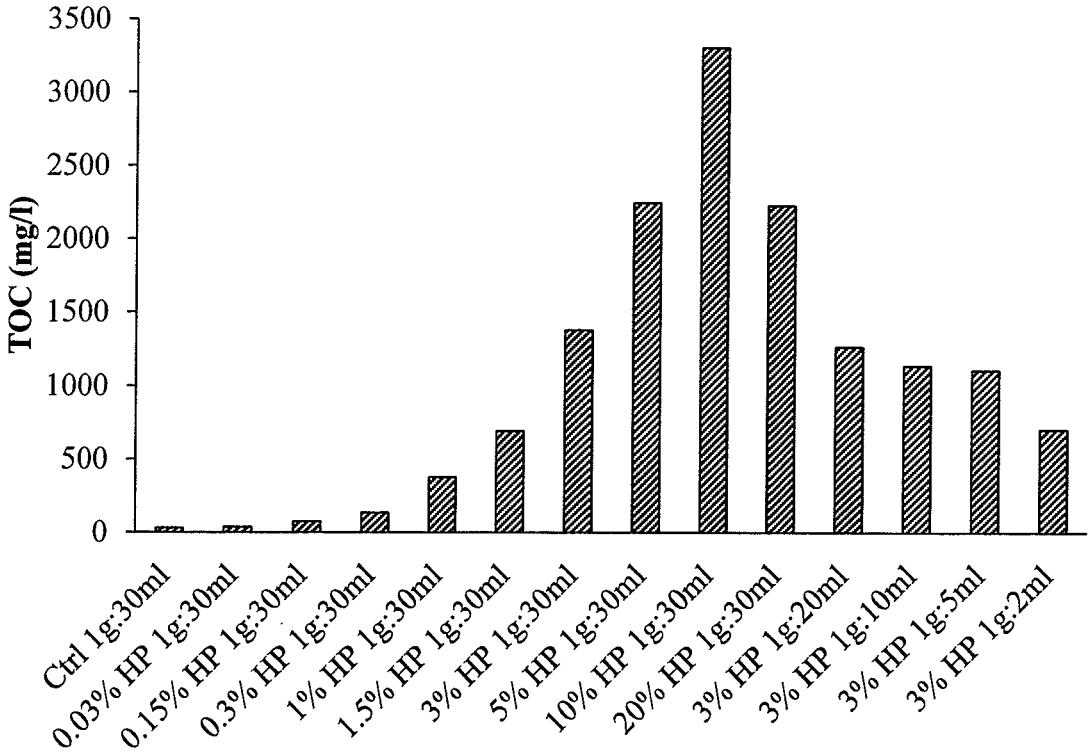
FIG. 2 is a graph of the total organic carbon solubilized from coal following pretreatment with hydrogen peroxide at various concentrations, illustrating optimized concentrations of hydrogen peroxide (uncatalyzed) maximizing the amount of total organic carbon, while higher concentrations over-oxidize the resulting organic carbon, with the controls being coal and de-ionized water (no oxidant).
Figure 3A:
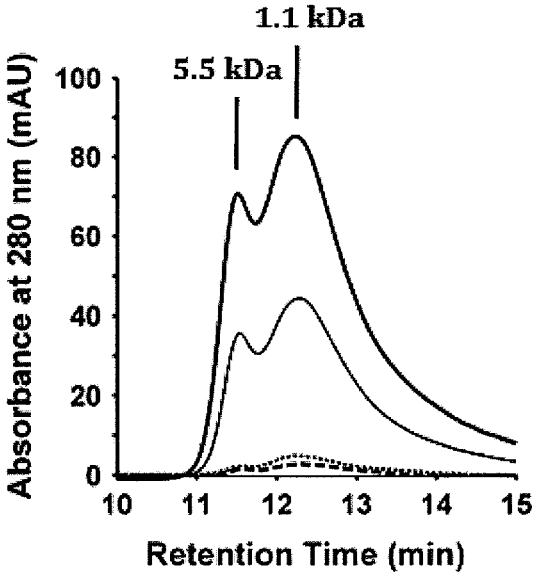
Figure 3B:
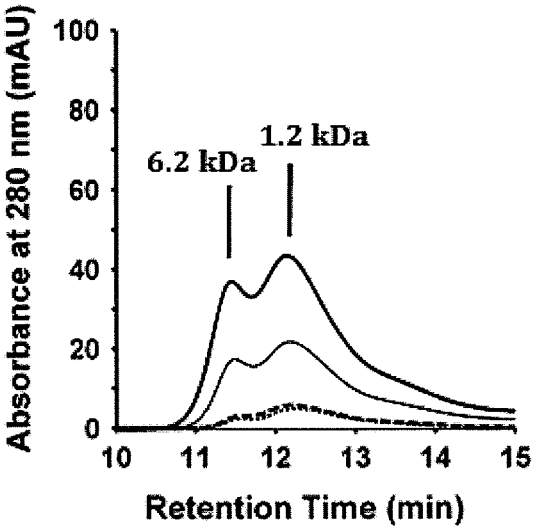
Figure 3C:
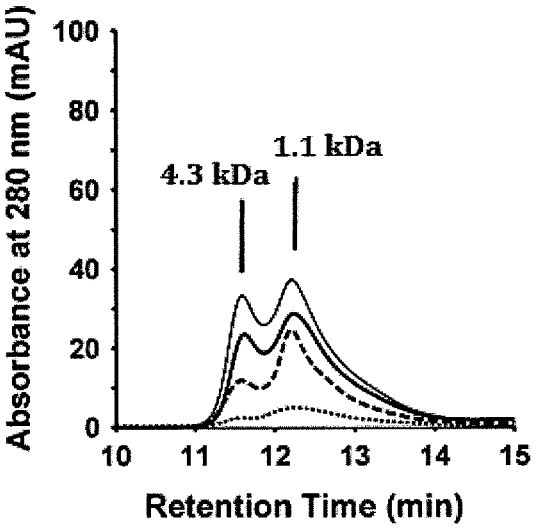
Figure 3D:
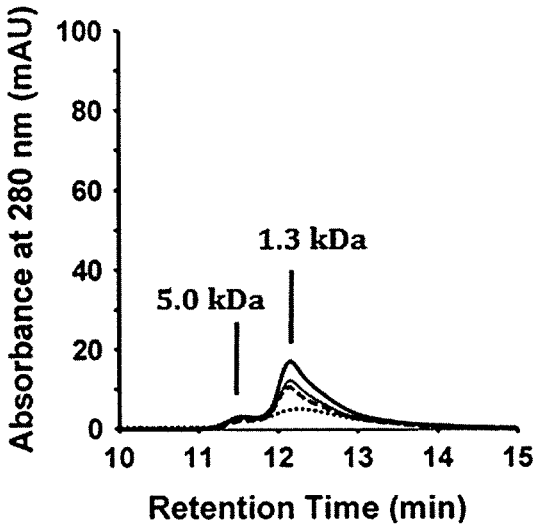

The loss of products in the catalyzed hydrogen peroxide pretreatment by these two effects has been confirmed pretreatment without the Fe(II) catalyst, and by optimizing the concentration of $H_2O_2$. One gram of ground coal was treated with a solution of 3% $H_2O_2$ for about 3 weeks. The liquid fraction was separated from the remaining solids and neutralized to a pH of about 7. Mineral, trace metal and vitamin solutions were prepared according to Hurst et al., 2007, Manual of Environmental Microbiology. 3rd Ed. Chapter 6, Page 69-78. ASM Press, Washington, D.C., and added accordingly (See, e.g., Liu, Y. et al., 2013, Int. J. Coal Geology doi: 10.1016/j.coal.2013.02.010.). A coal-derived inoculum (designated 21-32y) was used to inoculate the bottles. The culture was enriched from coal samples and used coal as the sole carbon source. A volume of 0.5 ml of inoculum was added to each of the bottles. Untreated coal was used as the control. The head space was routinely measured for methane production. FIG. 2 is a graph of the total organic carbon solubilized from coal following pretreatment with hydrogen peroxide at various concentrations, illustrating optimized concentrations of hydrogen peroxide (uncatalyzed) maximizing the amount of total organic carbon while higher concentrations over-oxidize the resulting organic carbon. It may be observed from this FIGURE that the TOC far exceeds that from FIG. 1.

9. High-Performance Size-Exclusion Chromatography (HPSEC):

No solubilization or depolymerization of aromatics from coal was observed in any of the experimental controls (water only, DMF without MnP, MnP without DMF; data not shown). FIG. 3 shows the HPSEC elution profiles of the various chemical pretreatments followed by exposure to the fungal MnP as compared with the enzymatic controls treated with MnP, but without any chemical pretreatment. In general, all of the chemical pretreatments enhanced the subsequent enzymatic conversions, and with the exception of $KMNO_4$, the concentration of the pretreatment agents had a significant effect on the subsequent enzymatic treatments.

Based on the absorbance of HPSEC chromatograms, $HNO_3$ was the most effective pretreatment agent of the four tested, followed by $H_2O_2$. In both cases, the medium and high concentrations of each reagent exerted the most distinct effects and roughly doubled the fragment release at twice the concentration (from 1.67 to 3.33 M for $HNO_3$ and 1.62 to 3.24 M for $H_2O_2$). The lowest chemical concentration had no significant effect on the release of water-soluble aromatics with results almost indistinguishable from the controls (FIGS. 2A and 2B). By contrast, all three $KMnO_4$ concentrations had an enhancing effect on the ability of MnP to oxidize coal, the largest effect being observed in the medium concentration of $KMnO_4$ (FIG. 2C); after alkaline pretreatment, only minor differences were observed with MnP oxidation, as indicated by the HPSEC elution profile (FIG. 2D).

Two characteristic elution peaks absorbing at the aromatic specific wavelength of 280 nm were observed in each of the three most effective combined chemical and enzymatic treatments (FIGS. 2A-C). Low-molecular weight mass fragments ranging between 1.1 and 6.2 kDa may be the cause of the peaks; indeed the masses appeared to be slightly different for different pretreatments as shown in the FIGURES (e.g., 5.5 and 1.1 kDa after pretreatment with $HNO_3$ or 6.2 and 1.3 kDa after $H_2O_2$).

From the HPSEC results following enzymatic reaction, oxidants, acids and alkaline agents each modify the coal structure in different ways. Potassium permanganate has an oxidation potential of 1.67 V. Although pH does not affect the oxidation potential of $KMnO_4$, it does affect the susceptibility of the substrate to oxidation (See, e.g., Arndt, D., 1975, Manganese compounds as oxidizing agents in organic chemistry, 4th ed. Open Court Publishing Company, La Salle, Ill. Chapter 4; and Burke et al., 1990, Fuel 69, 1370-1376.). The oxidation by $KMnO_4$ under basic conditions may result in over-oxidation of phenolic rings, polynuclear aromatic systems and heteroaromatic structures. Experimental evidence suggests that even when the initial reaction conditions are neutral, the pH becomes basic as the reaction proceeds (See, e.g., Hayatsu et al., 1981, Fuel 60, 158-161; and Burke et al., 1990, supra.), as in the present situation when the pH increased from neutral to about 8.5 after 24 h. Over-oxidation likely promotes ring opening of phenolic rings, polynuclear aromatics, and heteroaromatic structures and results in simple products such as carbon dioxide, acetic acid and oxalic acid. As the TOC data suggest, the higher the $KMnO_4$ concentration applied to the coal, the more carbon is depolymerized and solubilized into the aqueous phase. For the higher permanganate concentration, the coal structures were also likely over-oxidized, resulting in the ring opening as described previously suggesting that less of the structures remaining after the pretreatment were accessible to attack by the subsequent enzymatic treatments. It is suggested by the present inventors, that for the low pretreatment concentrations, the modification of the coal structure was not great enough and for the high concentrations, the modification was too great, to insure effective enzymatic transformation; therefore, the samples treated with the medium concentration of $KMnO_4$ exhibited higher absorbance values than those samples treated with the lowest and highest concentrations.

The oxidation potential for $H_2O_2$ is 1.78 V, slightly higher than $KMnO_4$ (1.67 V); however, the decomposition of $H_2O_2$ to hydroxyl radicals from Fenton reactions increases the oxidation potential to 2.8. Research by others has revealed that catalyzed $H_2O_2$ oxidizes toluene, nitrobenzene and chlorobenzene to phenol, cresols, biphenyls and benzaldehydes (See, e.g., Merz et al., 1949, J. Chem. Soc. 2427-2433.); therefore, the catalyzed $H_2O_2$ pretreatment may have acted as an oxidant, which would result in the higher than permanganate absorbances observed in the HPSEC chromatograms. However, yet others have reported the ring opening of phenol and mineralization of chlorophenols (Davidson et al., 1966, supra; and Barbeni et al., 1987, supra.). This mineralization results in lower absorbance values, which is contrary to the present results.

Based on the absorbance profiles from the HPSEC chromatograms (FIG. 2), $HNO_3$, with twice as much of the absorbance intensity as catalyzed $H_2O_2$ pretreated coal, was considered the most promising pretreatment agent of the four tested. Deno and coworkers, 1981, supra, documented that $HNO_3$ was able to cleave the aliphatic connectors between aromatic rings in coal. This would reduce the interconnectivity of the carbon clusters in the coal matrix which should favor MnP attack. Others have reported the occurrences of desulfurization and nitration (See, e.g., Alvarez et al., 2003, Fuel 82, 2007-2015; Rodriguez et al., 1996, Fuel 75, 606-612, and 1997, Fuel 76, 1445-1450), although it is unclear how these reactions assist enzymatic attack.

As shown in the HPSEC chromatograms, NaOH was the least effective of the pretreatment agents. NaOH has been used to remove ash and sulfur in coal (See, e.g., Araya et al., 1981, Fuel 60, 1127-1130; and Mukherjee et al., 2004, Fuel 82, 783-788.) and for the preparation of humic acid and fulvic acids (See, e.g., Hofrichter et al., 1996, supra; Juan et al., 1990, Fuel 60, 158-161; and Novak et al., 2001, Reactive and Functional Polymers 47, 101-109.). Although the TOC data indicate that sodium hydroxide can solubilize large amounts of carbon from coal, solubilization may be more physico-chemical reactions. The physic-chemical processes may leave the structure untouched which is unfavorable to subsequent enzymatic attack.

10. 3-Dimensional Excitation Emission Matrices Fluorescence Spectrophotometry (3D-EEM):

No EEM peaks were observed in any of the controls (water only, DMF without MnP, MnP without DMF; data not shown) for the indicated excitation emission wavelengths (Ex/Em), except for the enzymatic control. The controls containing MnP and DMF had extremely low fluorescence intensity at wavelengths from 380 to 400 for both emission and excitation (data not shown). The liquid samples from $KMnO_4$ and $HNO_3$ pretreated coals showed both humic acid- and fulvic acid-like peaks. None of the samples displayed protein-like peaks.

Low-concentration, $HNO_3$ pretreated coal showed no fluorescence, while pretreated coals exposed to medium- and high-concentrations showed increased intensity of both humic acid- and fulvic acid-like substances and for aromatics/PAHs. The peaks for humic and fulvic acid-like material occurred at Ex/Em wavelengths of 340/448 nm and 242.5/484, respectively. Among the pretreatment agents tested, the coal treated with high concentrations of $HNO_3$ exhibited the highest fluorescence intensities in the wavelengths attributed to aromatics/PAHs. The desulfurization and nitration that occurred through pretreatment with $HNO_3$ may have resulted in the breaking up of the aliphatic connectors between the aromatic rings within the coal. This may have led to a structural modification of the coal which, in turn, favored the enzymatic reactions (See, e.g., Deno et al., 1981, supra; Alvarez et al., 2003, supra; and Rodriguez et al., 1996, 1997, both supra.). Consequently, EEM spectra showed an intensity increase in aromatics/PAHs and humic and fulvic acid-like regions as the pretreatment concentration increased. In general, the results of EEM and HPSEC were consistent, that is, the higher concentration of the pretreatment agents result in the higher intensities.

Catalyzed $H_2O_2$ pretreated coal only showed fluorescence in the aromatic/PAH region. The intensity increased with increased pretreatment concentrations. The generation of hydroxyl radicals by the Fenton reaction has an oxidation potential of approximately 2.8 V; however, the hydroxyl radicals generated in the aqueous phase react almost instantaneously and likely have a limited ability to oxidize coal macromolecules because of mass transfer limitations (See, e.g., Watts et al., 1994, supra.). Although other EEM signals were not found, HPSEC chromatograms showed a higher absorbance at 280 nm for catalyzed $H_2O_2$ than $KMnO_4$. It is possible that catalyzed $H_2O_2$ pretreated coal generated more non-fluorophore containing compounds during the subsequent MnP treatments.

The fluorescence intensity for the humic and fulvic acid-like areas increased with increased concentration of pretreatment agent for the $KMnO_4$ pretreated coal; however, the aromatics/PAHs decreased. It is reasonable to assume that the decrease in aromatics/PAHs compounds as more $KMnO_4$ was applied to the coal resulted in over-oxidation of phenolic rings, polynuclear aromatics, and heteroaromatic structures under basic conditions (The resultant pH values were around 8.5; see, e.g., Arndt, 1975, supra; Burke et al., 1990, Fuel 69, 1370-1376; and Hayatsu et al., 1981, Fuel 60, 158-161.). The mechanism of the MnP is that the activated enzyme oxidizes $Mn^{2+}$ to $Mn^{3+}$; that is, in turn, chelated by carboxylic acids such as malonic acid (See, e.g., Hofrichter, 2002, supra.). This low-molecular weight diffusive redox-mediator then attacks the coal, particularly phenolic structures and amino-aromatic compounds, and returns to its reduced state ($Mn^{2+}$). The mechanism is similar to the oxidation by permanganate from $MnO_4^-$ to $MnO_2$ (Arndt, 1975). This similarity may explain the low fluorescence intensity at the aromatic/PAH regions with the higher concentration permanganate pretreated coals. The humic and fulvic acid-like peaks occurred at Ex/Em wavelengths of 307.5/422 nm and 232.5/426 nm, respectively. The observed increased peak intensity of the humic and fulvic acid-like peaks apparently offset the decrease in other regions and rendered medium permanganate treatment the highest absorbance in HPSEC analysis.

The NaOH pretreatments showed only aromatics/PAHs, regardless of the concentration of treatment agent applied, which correlated well with the HPSEC spectra. The NaOH is used to prepare humic and fulvic acid for enzymatic reaction experiments (See, e.g., Hofrichter et al., 1996, supra; Juan et al., 1990, supra; and Novak et al., 2001, supra.); it is not surprising then that no humic or fulvic acid-like peaks were visible in the EEM spectra. The NaOH was the least effective pretreatment agent with respect to both HPSEC and EEM data.

B. Enzymes Produced from the Fungus *Paecilomyces Variotii:*

Figure 4:
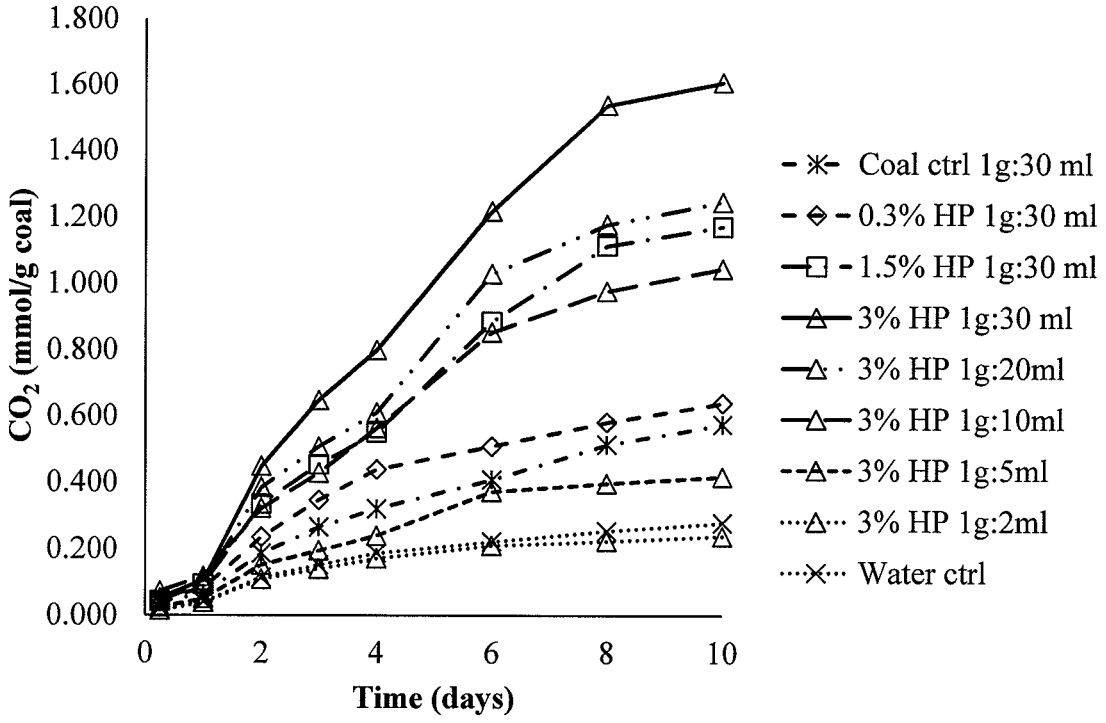
FIG. 4 is a graph of the cumulative $CO_2$ production per gram of coal as a function of time in days with *Paecilomyces variotii*, a fungus known to generate a wide variety of enzymes including tannase, as the sole aerobic microorganism contacting a coal sample, for several hydrogen peroxide concentrations.

*Paecilomyces variotii* is a fungus living on coal which produces a host of enzymes, including tannase. FIG. 4 is a graph of the cumulative $CO_2$ production per gram of coal as a function of time in days with *Paecilomyces variotii* as the sole aerobic microorganism contacting a coal sample, for several hydrogen peroxide concentrations. Unlike the data presented hereinabove for the situation where the enzyme MnP is added to the solution, the enzymes are produced by the *Paecilomyces variotii*, and $CO_2$ is being measured as opposed to the various types of organics generated. The quantity of $CO_2$ produced correlates to the amount of bioavailable carbon in the biometer used for the measurement, which is an apparatus for measuring $CO_2$ evolution. In the present situation, the amount of bioavailable carbon is also directly related to TOC.

The treated coal was separated from the liquid fraction which was added to biometer flasks (Bellco Glass, Inc., Vineland, N.J.). Six ml of 0.5 M Sorensen phosphate buffer was added to each biometer flask to ensure the pH was maintained within an acceptable range for optimal microbial activity. Triplicate samples were set up unless otherwise stated. The following procedure was used to ensure that the biometers were inoculated consistently for all measurements, while minimizing the amount of additional carbon added to the system. First, the bacteria were grown and isolated on nutrient agar plates. A single colony of the organism was added to a 150-ml beaker of sterile nutrient broth and grown for 15 h at 30° C. Then, one ml of this bacterial culture was added to 150 ml of sterile nutrient broth and grown for approximately 30 h to an optical density reading of 1.5 at 600 nm. An aliquot of 20 ml of cells was washed by centrifuging at 4000 rpm, removing the liquid, and re-suspending the centrifuged cells in a solution of phosphate-buffered saline to remove residual carbon from the unused nutrient broth. One ml of the solution was inoculated into each biometer flask. The ml of 0.05 M potassium hydroxide (KOH) solution was poured into the side arm of the biometer flask. The $CO_2$ gas produced by the organism was trapped when it dissolved into the KOH solution. A titration was performed on the KOH using 0.05 M hydrochloric acid to determine the amount of $CO_2$ produced. After each titration, the side arm was refilled with 10 ml of fresh 0.05 M KOH.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for depolymerizing and solubilizing subbituminous coal, comprising:

treating untreated coal with an aqueous basic solution forming thereby treated coal and coal-derived constituents; and exposing the treated coal and coal-derived constituents formed in said step of treating the coal with an aqueous basic solution to an aqueous solution comprising at least one enzyme effective for reacting with said treated coal and coal-derived constituents.

2. The method of claim 1, wherein the at least one base comprises sodium hydroxide.

3. The method of claim 1, wherein the at least one enzyme comprises peroxidase enzymes.

4. The method of claim 3, wherein the peroxidase enzymes comprise manganese peroxidase.

5. The method of claim 4, wherein the manganese peroxidase is generated from fungus comprising white rot fungus.

6. The method of claim 5, wherein the white rot fungus is chosen from *Phlebia radiata, Clitocybula dusenii* and *Bjerkandera adusa*, and mixtures thereof.

7. The method of claim 1, wherein the at least one enzyme is generated by *Paecilomyces variotii.*

8. The method of claim 7, wherein the at least one enzyme generated by *Paecilomyces variotii* comprises tannase.

* * * * *